US009833721B2

(12) United States Patent
Plouffe

(10) Patent No.: US 9,833,721 B2
(45) Date of Patent: Dec. 5, 2017

(54) BALLOON TYING AID

(71) Applicant: Marque Plouffe, Lethbridge (CA)

(72) Inventor: Marque Plouffe, Lethbridge (CA)

( * ) Notice: Subject to any disclaimer, the term of this patent is extended or adjusted under 35 U.S.C. 154(b) by 0 days.

(21) Appl. No.: 14/474,729

(22) Filed: Sep. 2, 2014

(65) Prior Publication Data

US 2016/0059141 A1 Mar. 3, 2016

(51) Int. Cl.
*A63H 27/10* (2006.01)

(52) U.S. Cl.
CPC ..... *A63H 27/10* (2013.01); *A63H 2027/105* (2013.01)

(58) Field of Classification Search
CPC ..... A63H 27/10
USPC ..... 289/17, 1.5
See application file for complete search history.

(56) References Cited

U.S. PATENT DOCUMENTS 1,783,001 A * 11/1930 Raetz ..... B65H 69/04 289/17
2,048,300 A * 7/1936 Showers ..... D06F 53/00 24/130
2,095,082 A * 10/1937 Reichenberg ..... A47J 43/283 30/322
2,191,226 A * 2/1940 Clem ..... A47J 37/0694 294/50
2,293,910 A * 8/1942 Lukken ..... A01G 1/12 294/52
2,406,175 A * 8/1946 Talley ..... A01D 9/00 294/55.5
2,442,551 A * 6/1948 Schaefer ..... A47J 43/283 30/129
2,629,313 A * 2/1953 Norville, Jr. ..... A47J 37/0694 99/421 R
2,720,699 A * 10/1955 Boruvka ..... A47G 21/023 30/322
2,801,873 A * 8/1957 Faughnder ..... A47J 43/288 126/9 B
2,864,163 A * 12/1958 Boruvka ..... A47J 43/283 126/9 B
3,223,440 A * 12/1965 Rosenzweig ..... D04D 7/10 223/46
3,307,864 A * 3/1967 Rosenzweig ..... D04B 7/06 289/1.2

(Continued)

FOREIGN PATENT DOCUMENTS

CA 2821396 A1 6/2012
CN 203043456 U 7/2013

OTHER PUBLICATIONS

Purported English Language Translation of CN 203043456 U that appears to be partial, states a filing date of Jan. 11, 2013.

*Primary Examiner* — Shaun R Hurley
*Assistant Examiner* — Bao-Thieu L Nguyen
(74) *Attorney, Agent, or Firm* — Orin Del Vecchio

(57) ABSTRACT

A device and technique for knotting an inflated balloon or forming a knot in another material is provided. One approach includes: holding a knot tying aid by a handle portion, the handle portion being positioned opposite a distal portion, the distal portion including several prongs (in one nonlimiting example at least three) extending away from the handle and being spaced apart from one another in correspondence to vertices of a triangle; winding a tag end portion of the inflated balloon about the prongs to form a loop; and passing part of the tag end portion through the loop to form a knot.

7 Claims, 3 Drawing Sheets

(56) References Cited

U.S. PATENT DOCUMENTS

| | | | | |
|---|---|---|---|---|
| 4,510,653 | A | 4/1985 | Semanko | |
| 4,802,877 | A | 2/1989 | Davis et al. | |
| 4,989,906 | A * | 2/1991 | Peverley | A63H 27/10 289/17 |
| 5,039,142 | A * | 8/1991 | Muma | A63H 27/10 289/17 |
| 5,098,137 | A | 3/1992 | Wardall | |
| 5,314,217 | A | 5/1994 | Place | |
| 5,647,615 | A * | 7/1997 | Messier | A63H 27/10 289/17 |
| 5,927,764 | A * | 7/1999 | Harriman | A47G 25/88 223/113 |
| 6,082,785 | A | 7/2000 | Morgan et al. | |
| 6,325,426 | B1 * | 12/2001 | Boesl | A63H 27/10 289/1.5 |
| 6,540,267 | B1 * | 4/2003 | Rohbock | D04G 5/00 289/1.2 |
| 6,902,212 | B1 * | 6/2005 | Mize | A63H 27/10 289/17 |
| 7,549,683 | B1 | 6/2009 | Sikorcin | |
| D621,232 | S * | 8/2010 | Lion | D7/653 |
| D651,484 | S * | 1/2012 | Zemel | D7/683 |
| 8,141,326 | B2 * | 3/2012 | Wang | A63H 27/10 141/314 |
| 8,292,335 | B1 * | 10/2012 | Hemingway | A63H 27/10 289/17 |
| D682,642 | S * | 5/2013 | Baker | D8/13 |
| 8,631,842 | B2 * | 1/2014 | Dancescu | A63H 27/10 141/114 |
| D715,373 | S * | 10/2014 | Thompson | D21/453 |
| 2003/0160453 | A1 | 8/2003 | Jolly | |
| 2010/0038906 | A1 * | 2/2010 | Herren | A63H 27/10 289/17 |
| 2012/0097293 | A1 * | 4/2012 | Dancescu | A63H 27/10 141/317 |

* cited by examiner

BALLOON TYING AID

BACKGROUND

The present application relates to a tying aid and more particularly, but not exclusively, relates to a knot tying device, technique, method, and system suitable for balloons in an inflated state.

The tying of an inflated balloon is awkward for many people—sometimes leading to a longing for a third hand to manage the operation. To cope with this problem, there have been a number of schemes proposed that involve dedicated, sometimes complicated, objects with slits or slots to hold a part of the balloon while attempting to tie it. These objects can be cumbersome to use, making it difficult to readily and consistently obtain a satisfactory result. Thus, there is an ongoing demand for further contributions in this area of technology.

SUMMARY

One embodiment of the present application includes a unique technique for tying a knot with a knot tying aid. This aid finds particular application in the tying of an inflated balloon and may be readily and applied. It can also be extended to placing knots, stoppers, crimps, pinchers, clamps, clips, or the like for not only an inflated balloon, but alternatively for other items that would benefit from the same.

A further form of an embodiment of the present application includes: placing a balloon in an inflated state, the balloon including a tag end portion defining a fluid port; holding a knot tying aid, the knot tying aid including a proximal handle positioned opposite a distal end portion, the distal end portion including at least three prongs extending away from the handle and a corresponding number of arms, each one of the arms being joined to the handle and a respective one of the prongs to define a corresponding elbow shape, the arms extending laterally away from the handle in relation to a longitudinal centerline axis of the handle; winding the tag end portion of the inflated balloon about the prongs to form a loop from the tag end portion, the loop including a crossed portion and defining an opening; and positioning the tag end portion through the opening of the loop to form a knot to close the port while the balloon is in the inflated state.

Alternatives and variations of this form include the addition of: moving the tag end portion to pass through the opening; pulling the tag end portion after moving it to pass through the opening to tighten the knot; and/or removing the loop from one or more of the prongs of the balloon tying aid. In addition to or in lieu of these alternatives, still others comprise the addition of: the balloon tying aid being formed from at least one of a metal, a wood, a ceramic, a thermoset polymer, and a thermoplastic polymer; the prongs approximately corresponding to vertices of a triangle of the isosceles or equilateral type; each elbow shape approximately corresponding to a right angle; removing the loop from a first one of the prongs before other of the prongs while tightening the knot; pulling the tag end portion to tighten the knot; and/or the tying aid being held by the handle while—the tag end portion is wound about the prongs, the tag end portion is positioned through the opening, the loop is removed, and/or the tag end portion is pulled to tighten the knot.

Yet another embodiment of the present application includes a way of knotting a balloon in an inflated state, comprising: holding a device with a handle positioned opposite a device end portion, the device end portion including at least three elongated projections spaced apart from each other, the projections each being fixed to the handle and extending laterally in relation to a longitudinal centerline axis of the handle; wrapping a balloon end portion about the projections of the device to form a loop defining an opening, the balloon end portion defining a port to inflate the balloon; and placing the balloon end portion through the opening to form a knot in the balloon end portion while the balloon is in the inflated state, the knot being tightened to maintain the inflated state of the balloon and close the port.

Various alternatives include the addition of: the knot being formed by pulling on the balloon end portion as the loop is removed from at least one of the prongs; the projections each extend with a longitude approximately parallel to the longitudinal centerline axis of the handle; and/or the loop having a crossed portion to form the knot and further comprising pinching the port closed; removing the loop from the projections as the knot is tightened to secure the inflated state of the balloon; forming a crossed portion in the loop during the wrapping of the balloon end portion to provide a closed form of the loop; pulling the balloon end portion to tighten the knot; and/or holding the device by the handle portion while the balloon end portion is wrapped, and/or the balloon end portion is placed through the opening.

Another embodiment of the present application is a device to aid with formation of a knot in a balloon after inflation thereof. The balloon includes a tag end portion with a fluid port. The device comprises: a proximal end portion including a handle; a distal end portion opposite the proximal end portion, the distal end portion including three elongated prongs and three arms, the elongated prongs each being connected to the handle by a respective one of the arms, the arms each extending away from the handle, the elongated prongs each projecting from the respective one of the arms to form an elbow shape with the respective one of the arms and terminate in a corresponding number of prong end portions in a spaced apart relationship relative to one another and laterally in relation to a longitudinal centerline axis of the handle. The prong end portions correspond to vertices of a triangle, and are sized and shaped to wind the tag end portion of the balloon thereabout to form a closed loop with a crossed portion. The loop defines an opening. The opening is receptive to positioning of the tag end portion therethrough to form the knot in the tag end portion and slip the loop off the prongs as the knot is tightened.

Alternatives include the addition of: the device further including the balloon in an inflated state and the elbow shape approximately defining a right angle; the vertices approximately corresponding to an isosceles triangle or an equilateral triangle; and/or the device being formed of at least one of a metal material, a thermoset polymer material, a ceramic material, a wood material, and a thermoplastic polymer material.

A further embodiment of the present application includes a method of knotting an item, comprising: holding a device with a proximal handle opposite a distal end portion, the distal end portion including at least three elongated projections connected to the handle, the projections extending away from the handle to terminate opposite the handle in a corresponding number of projection end portions, the projection end portions being spaced apart from one another and being positioned transverse to a longitudinal centerline of the handle; placing a tag end portion of the item about the projections of the device to form a loop defining an opening; and positioning the tag end portion through the opening to form a knot in the tag end portion of the item. In a related form, the tag end portion is wound about the projections a number of times to form a corresponding number of turns around the opening and/or the projection end portions corresponding to vertices of a triangle.

Still other forms, embodiments, applications, techniques, objects, benefits, advantages, and variations will become apparent from the description and figures provided herewith.

BRIEF DESCRIPTION OF THE DRAWING(S)

FIGS. 1 and 2 have view planes perpendicular to one another.

FIGS. 1-3 each have a view plane perpendicular to the others.

FIGS. 3-5 correspond to different stages of the procedure depicted in the flowchart of FIG. 6.

DETAILED DESCRIPTION OF REPRESENTATIVE EMBODIMENTS

Figure 1:
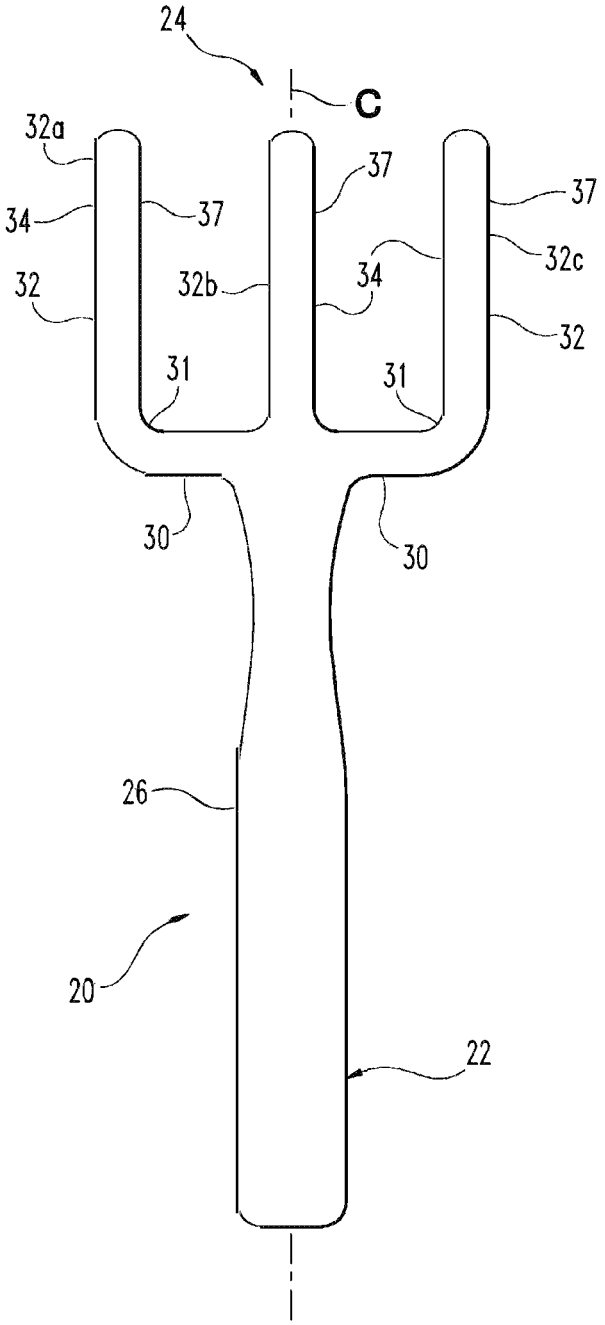
FIG. 1 is a partial diagrammatic front view of a balloon tying aid device of the present application.

For the purposes of promoting an understanding of the principles of any invention provided herein, reference will now be made to the embodiments illustrated in the drawing(s) and specific language will be used to describe the same. It will nevertheless be understood that no limitation of the scope of any invention is thereby intended. Any alterations and further modifications in the described embodiments, and any further applications of the principles of the same as described herein are contemplated as would normally occur to one skilled in the art to which they relate.

One embodiment of a present application is a system that utilizes a balloon tying aid comprising at least two prongs to hold open a loop in the end part of a balloon, thereby facilitating easy knot formation and closure. The prongs are spaced apart from one another and extend from a conveniently sized and shaped handle to further facilitate knot tying with ease. In fact, this device can be employed to address other knot tying challenges as they arise; and further may be employed to place stoppers, clamps, crimps, pinchers, clips or the like in lieu of or in addition to a knotted closure.

Figure 2:
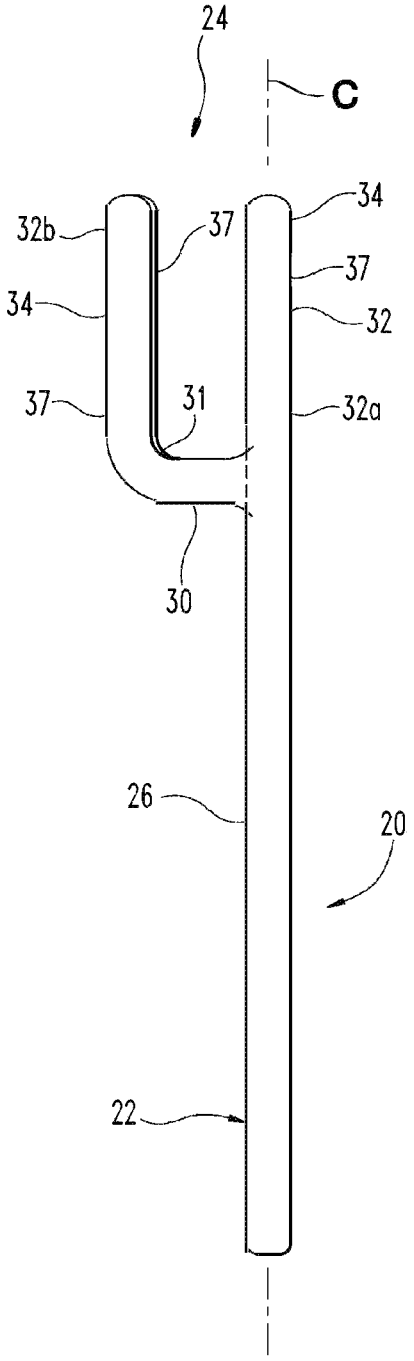
FIG. 2 is a partial diagrammatic side view of the device of FIG. 1.
Figure 3:
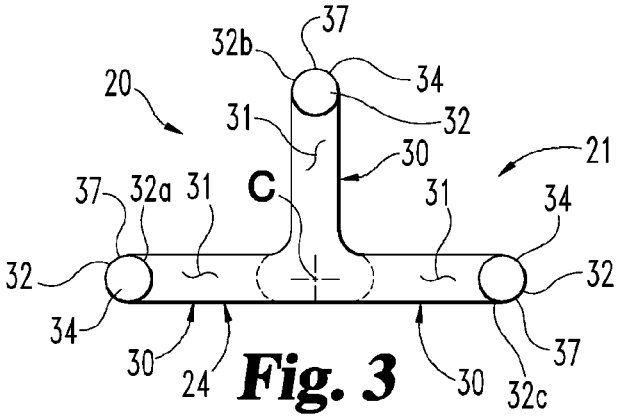
FIG. 3 is a partial diagrammatic top view of the device of FIGS. 1 and 2.

FIGS. 1-3 present another embodiment of the present application in the form of knot tying aid 21, which is further designated as device 20. Referring specifically to FIG. 1, a front view of device 20 is shown. Device 20 includes a proximal device end portion 22 that is positioned opposite distal device end portion 24. Proximal end portion 22 includes handle 26. Handle 26 is elongated in the depicted embodiment, having a longitudinal centerline axis C shown in the standard manner. As illustrated, axis C is also coaxial or parallel with a representation of longitude of device 20, aid 21, end portion 22, and end portion 24. In other embodiments, the centering and/or longitude of handle 26, device 20, aid 21, end portion 22, and end portion 24 may vary as would occur to those skilled in the art.

Distal end portion 24 includes a number of projections 37 specifically labeled prongs 32*a*, 32*b*, and 32*c*. Collectively, projections 37 are also designated elongated prongs 32. Elongated prongs 32 each end with a termination or device projection end portion 34. Optionally, projection end portions 34 may be rounded, radiused, smoothed, and/or otherwise finished/shaped to facilitate performance of various operations with aid 21 as further described hereinafter.

Referring additionally to FIG. 2, like reference numerals refer to like features as previously described. FIG. 2 presents a side view of device 20, with a view plane that extends perpendicular to the view plane of FIG. 1. As illustrated in FIGS. 1 and 2, end portion 24 includes one offsetting arm 30 for each projection 37. Each arm 30 connects to and is contact with handle 26 at one end and a corresponding different prong 32 at an opposite end. Arms 30 each extend or project laterally in relation to axis C to define an elbow shape 31. Every arm-connected prong 32 has a longitude that is parallel to, but is offset from or transverse to axis C and shape 31 approximately corresponds to a right angle. In other embodiments, different longitudinal relationships among prongs 32, different relationships of prongs 32 to the center/longitude of handle 26, and/or a different angle for elbow shape 31 may be realized.

Referring now also to FIG. 3, like reference numerals refer to like features as previously described. In FIG. 3, aid 21 is depicted with a view plane perpendicular to the view planes of both FIGS. 1 and 2, and accordingly axis C is depicted by cross hairs because it is perpendicular to the FIG. 3 view plane. Likewise, longitude of each one of projections 37 is parallel to longitude of the other projections 37 and axis C. Device 20 may be made from any suitable material. In a preferred embodiment, device 20 is formed from at least one of a metal, a thermoset polymer, a thermoplastic polymer, a ceramic, and a wood material. In a more preferred embodiment, device 20 is made from a unitary piece of metal or a polymeric resin of a thermoset or thermoplastic type. In an even more preferred embodiment, device 20 is made from a molded or extruded single piece of a thermoset or thermoplastic polymeric material. In other preferred embodiments, device 20 may be a unitary piece formed by molding, stamping, pressing, extrusion, machining, etching, cutting, or casting. For still further embodiments, device 20 is formed from multiple pieces each fabricated and joined together using standard techniques. In one particular arrangement, device 20 is formed from a multi-tined metallic eating utensil, like a table fork.

As depicted in FIGS. 1-3, each one of arms 30 forms a generally right-angled elbow shape 31 that offsets projections 37 from handle 26; however, in other arrangements, arm 30 may be differently shaped, may or may not have an elbow shape 31 at all, and/or may be altogether absent. In one alternative (not shown), prongs 32 extend along generally straight pathways diverging away from each other relative to a connection to handle 26. In one particular example, the three projections 37 (and prongs 32) correspond to three edges of a tetrahedron (a pyramid with four triangular faces) joined to each other and handle 26 at a common vertex (not shown)—lacking any distinct elbow shapes 31 or separate arms 30. Notably, such divergence, and the extension of arms 30/elbows 31 still provides a lateral offset of end portions 34 relative to axis C. In further embodiments, arms 30 and/or elbow shape 31 is/are subsumed by prongs 32 and projections 37 or vice versa. In still other embodiments, prongs 32 and projections 37 are differently shaped with or without arms 30 and/or elbow shape 31.

Prongs 32*a* and 32*c* are generally in the same plane as handle 26 in a spaced apart relationship as best shown in FIG. 2 given that prongs 32*a* and 32*c* extend laterally from handle 26. Prong 32*b* extends away from prongs 32*a* and 32*c* along a plane approximately parallel to the FIG. 2 view plane. Referring also to FIG. 3 a top down view of prongs 32 best illustrates that prongs 32 collectively correspond to vertices of a triangle. In one preferred form, the triangle corresponds to one with each side being of a different length. In a more preferred form, the triangle is approximately of an isosceles type. In an even more preferred form, the triangle is approximately of an equilateral type.

Figure 4:
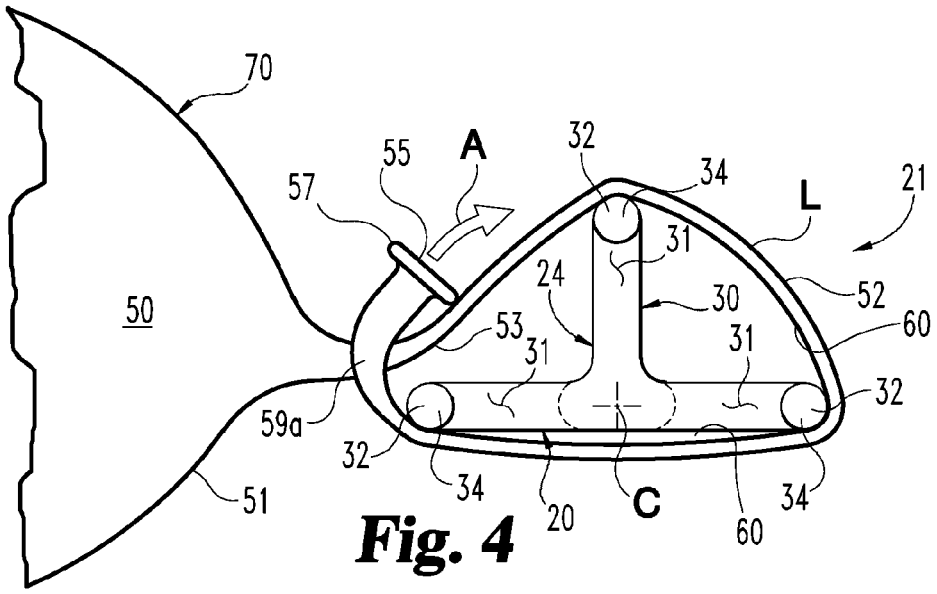
FIG. 4 is a partial diagrammatic top view of the device of FIGS. 1-3 with the tag end of an inflated balloon partially engaged therewith.
Figure 5:
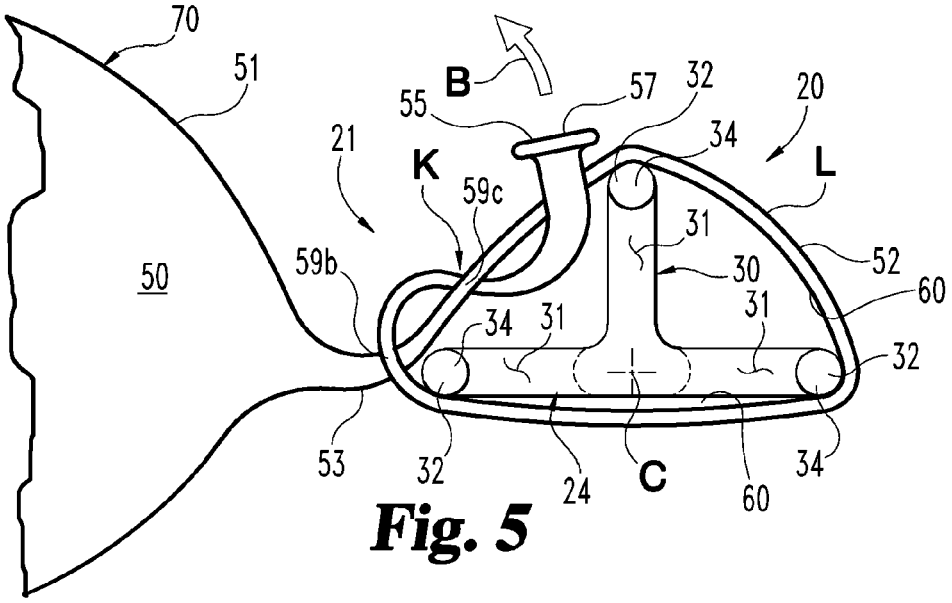
FIG. 5 is a partial diagrammatic top view of the device of FIGS. 1-3 with the tag end of the balloon in a more advanced stage of engagement—being wrapped around the device. The view planes of FIGS. 3-5 are coextensive.
Figure 6:
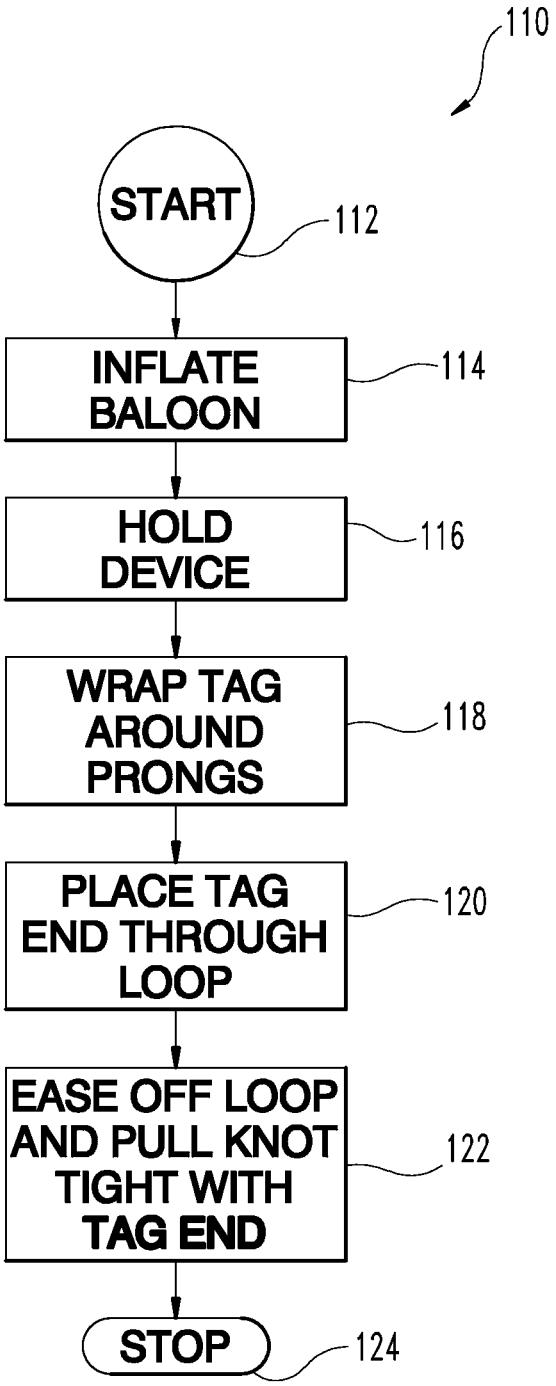
FIG. 6 is a view of a flowchart of one procedure for using the device of FIGS. 1-3.

Referring to FIGS. 4-6, one mode/embodiment of a process for operating device 20 is next described as procedure 110, with like reference numerals refer to like features previously described in connection with FIGS. 1-3. FIGS. 4 and 5 are in the same view plane as FIG. 3, but further illustrate different operations of procedure 110 in terms of different depictions of item 70 in these figures, where item 70 is subject to these operations; and while FIG. 6 presents a flow chart of procedure 110. As shown specifically in FIGS. 4 and 5, item 70 is in the form of an inflated balloon 50. Balloon 50 includes a bulbous inflated portion 51 (partly shown) integrally connected to tag end portion 52. Tag end portion 52 includes neck portion 53 that terminates in a fluid inflation/deflation port 55 defined by balloon end part 57 of portion 52. Balloon 50 may be of a standard elastomeric type, a mylar type, a natural membrane type, and/or such other composition/arrangement as would occur to those skilled in the art. In one arrangement, at least a portion of balloon 50 is reinforced with a mesh, threading, ribs, or other framework suitable to lend strength and/or impart a specific shape to the same. Other arrangements lack such aspects.

FIG. 6 particularly illustrates procedure 110 beginning with entry/start operator 112. After operator 112, stage 114 is performed. Stage 114 includes inflating balloon 50 with a fluid in a standard manner—such fluid typically being pressurized water, air, helium, or such other gas or liquid (both fluids) as would occur to those skilled in the field. During stage 114, the fluid can be introduced through port 55 of end part 57 to a desired level—preferably so that tag end portion 52 can be readily manipulated according to later stages of procedure 110. In one nonlimiting form, inflation is provided by a user blowing into balloon 50 through port 55 with balloon 50 being of a standard elastomeric type. In a further form, a tank of pressurized air or helium is utilized to fill balloon 50 through port 55. In still a further form, balloon 50 is filled through port 55 by water from a garden hose that provides it under pressure.

From the inflation operation in stage 114, stage 116 of procedure 110 is next encountered. Stage 116 includes holding handle 26 of device 20 or otherwise grasping aid 21 in one hand of a user (not shown), and manipulating tag end portion 52 with the other hand of the user, while bulbous inflated portion 51 under an arm or the like. During these operations, stage 116 further includes manipulating tag end portion 52 to control closure of port 55 so that a desired state of inflation of balloon 50 is maintained. This operation may include releasing some pressurized fluid through port 55 from portion 51 to provide a desired size and/or flexibility of portion 52 in preparation for subsequent stages of procedure 110; and/or closing port 55 as applicable. Such closure may be provided by pinching between the user's fingers or by utilizing a stopper, clip, clamp, pinchers, crimp or other device/body part to prevent undesired fluid loss (deflation) via port 55. The inflated part of balloon 50 is held away from device 20 (such as under one arm of the user) to keep one of the user's hands free to manipulate tag end portion 52.

From stage 116, procedure 110 continues with stage 118. Stage 118 includes a user wrapping and/or winding tag end portion 52 about prongs 32 or otherwise engaging projections 37 with tag end portion 52 to form loop L. Loop L has one part of tag end portion 52 that crosses over or under another part of tag end portion 52 to define crossed portion 59*a* as designated in FIG. 4. As perhaps best shown in FIG. 4, the margins of loop L and prongs 32 cooperate to define an opening 60. Loop L is shown with its constituent parts of tag end portion 52 somewhat in tension to present loop L and opening 60 with an approximately triangular shape in keeping with projection end portions 34 corresponding to vertices of a triangle as previously described. As depicted in FIGS. 4 and 5, these vertices approximately correspond to those of an equilateral triangle. In still other embodiments, a different type of triangular shape in correspondence to projection end portion 34 vertices is envisioned. In yet other embodiments having more or fewer than three prongs 32/projections 37, a nontriangular shape, pattern, and/or geometry is envisioned.

Stage 120 is performed following stage 118. In stage 120, balloon end part 57 and correspondingly port 55 of tag end portion 52 is passed through loop L and opening 60 to form knot K to secure balloon 50 in an inflated state. As shown in FIG. 4, arrow A is illustrated, along which port 55 and balloon end part 57 follow to begin knot K formation from tag end portion 52. As shown in FIG. 5, arrow B indicates the direction for balloon end part 57 of tag end portion 52 to follow to further advance formation of knot K. Also, crossed portion 59*b* and crossed portion 59*c* are formed with the performance of stage 120 as depicted in FIG. 5, being indicative of progress of knot K formation. Crossed portions 59*b* and 59*c* (FIG. 5) may or may not include any of the constituent parts of tag end portion 52 that provide crossed portion 59*a* (FIG. 4) due to relative movement and/or stretching of some or all of tag end portion 52—as it advances from the configuration in FIG. 4 to that shown in FIG. 5. With more advancement of knot K formation, balloon end part 57 of tag end portion 52 is pulled tighter (under tension) and potentially stretches. Referring additionally to Stage 122, tightening of knot K continues by pulling balloon end part 57 of tag end portion 52, approaching completion. As such tightening occurs, loop L is eased off the prongs 32, perhaps only one at a time, with pulling of the knot K configuration continuing until reaching its final form to provide a reliable closure to port 55.

In other embodiments, it should be appreciated that a "slip loop" can be formed and knotted in tag end portion 52 (not shown) that comes undone by pulling on balloon end part 57; and/or any other kind of knot K as could be provided by those skilled in the field may be utilized. Additionally or alternatively, still other embodiments include more than one complete turn of tag end portion 52 of balloon 50 around projections 37 to establish a more secure frictional purchase between tag end portion 52 and projections 37 and/or to provide closure of tag end portion 52 sufficient to maintain inflation of portion 51 until a knot K can be tied. In contrast, FIG. 5 depicts only one complete turn with one partial turn of tag end portion 52 around projections 37. In yet other embodiments, a clamp, stopper, crimp, pincher, clip or the like may be used with or without knot K to provide a desirable closure. Accordingly, from stage 122, a secure closure to port 55 of balloon 50 is provided so that balloon 50 will maintain an inflated state. Indeed, it is recognized that at least some balloon closures and/or fabrication materials are subject to some degree of leakage or other means of deflation that is to be expected after a certain amount of time the desired inflated state of balloon 50 has been maintained. Upon conclusion of stage 122, procedure 110 advances to operator 124, where it halts. Procedure 110 may or may not be repeated as desired for other balloons or like devices with operations 112-124 repeated or modified as applicable.

Any theory, mechanism of operation, proof, or finding stated herein is meant to further enhance understanding of one or more of the inventions and is not intended to make any invention in any way dependent upon such theory, mechanism of operation, proof, or finding. It should be understood that any use of the words "preferable, preferably, preferred, morem preferred, even more preferred, and most preferred" in the description above indicates that the feature so described may be desirable, it nonetheless may not be necessary and any embodiment lacking the same comes within the scope of any corresponding invention of the present application, that scope being defined by the claims that follow. While one or more selected embodiments have been illustrated and described in detail in the drawings and foregoing description, the same is to be considered as illustrative and not restrictive in character, it being understood that only the selected embodiments have been shown and described, and that all changes, modifications and equivalents that come within the spirit of the invention(s) as defined herein or by any of the following claims are desired to be protected.

What is claimed is:

1. A method of knotting, comprising:

placing a balloon in an inflated state, the balloon including a tag end portion defining a fluid port;

holding a knot tying aid, the knot tying aid including a proximal handle positioned opposite a distal end portion, the distal end portion including at least three prongs extending away from the proximal handle and a corresponding number of arms, each one of the arms being joined to the proximal handle and a respective one of the prongs to define a corresponding elbow shape, the arms extending away from the proximal handle laterally in relation to a longitudinal centerline axis of the proximal handle;

winding the tag end portion of the inflated balloon about the prongs, the prongs being spaced apart with a gap therebetween to form a corresponding loop from the tag end portion, and the prongs corresponding to vertices of a triangle with the loop positioned thereabout, the loop including a crossed portion and defining an opening; and positioning the tag end portion through the opening of the loop to form a knot to close the port while the balloon is in the inflated state.

2. The method of claim 1, which includes:

moving the tag end portion over or under the loop to pass through the opening during the positioning of the tag end portion;

pulling the tag end portion after the moving of the tag end portion to pass through the opening to tighten the knot; and removing the loop from one or more of the prongs of the balloon tying aid.

3. The method of claim 1, wherein the vertices approximately correspond to an isosceles triangle and each elbow shape approximately defines a right angle.

4. The method of claim 3, wherein the vertices approximately correspond to an equilateral triangle.

5. The method of claim 1, which includes removing the loop from a first one of the prongs before other of the prongs while tightening the knot.

6. The method of claim 5, which includes pulling the tag end portion to tighten the knot.

7. The method of claim 6, wherein the holding of the knot tying aid is by the proximal handle during the winding of the tag end portion, the positioning of the tag end portion through the opening, the removing of the loop from the first one of the prongs, and the pulling of the tag end portion to tighten the knot.

* * * * *